US009216517B2

(12) United States Patent
Kurzenberger et al.

(10) Patent No.: US 9,216,517 B2
(45) Date of Patent: Dec. 22, 2015

(54) HANDHELD WORK APPARATUS

(75) Inventors: Jan Kurzenberger, Köngen (DE); Johannes Menzel, Wernau (DE); Helmut Lux, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 903 days.

(21) Appl. No.: 13/333,796

(22) Filed: Dec. 21, 2011

(65) Prior Publication Data

US 2012/0160532 A1 Jun. 28, 2012

(30) Foreign Application Priority Data

Dec. 22, 2010 (DE) ..... 10 2010 055 673

(51) Int. Cl.
*B25F 5/00* (2006.01)
*B27B 17/00* (2006.01)

(52) U.S. Cl.
CPC ..... *B27B 17/0033* (2013.01); *B25F 5/006* (2013.01)

(58) Field of Classification Search
CPC ..... B25D 17/04; B25D 17/043; B25D 17/24; B27B 17/0033; B25F 5/006
USPC ..... 173/161.1, 162.1, 162.2
See application file for complete search history.

(56) References Cited

U.S. PATENT DOCUMENTS

| | | | | | |
|---|---|---|---|---|---|
| 5,361,500 | A * | 11/1994 | Naslund et al. | ..... | 30/381 |
| 5,368,107 | A | 11/1994 | Taomo | | |
| 6,148,930 | A * | 11/2000 | Berger et al. | ..... | 173/162.2 |
| 6,799,642 | B2 * | 10/2004 | Wolf et al. | ..... | 173/162.2 |
| 6,994,068 | B2 * | 2/2006 | Menzel et al. | ..... | 123/192.1 |
| 7,523,790 | B2 * | 4/2009 | Arakawa et al. | ..... | 173/162.2 |
| 2005/0247464 | A1 * | 11/2005 | Hellbach et al. | ..... | 173/162.2 |
| 2006/0000438 | A1 * | 1/2006 | Wolf et al. | ..... | 123/198 E |
| 2008/0000664 | A1 * | 1/2008 | Steinke | ..... | 173/162.2 |
| 2008/0276469 | A1 * | 11/2008 | Guip et al. | ..... | 30/383 |
| 2010/0206594 | A1 * | 8/2010 | Meixner | ..... | 173/162.2 |

* cited by examiner

*Primary Examiner* — Thanh Truong
*Assistant Examiner* — Joshua Kotis
(74) *Attorney, Agent, or Firm* — Walter Ottesen P.A.

(57) ABSTRACT

A handheld work apparatus has a drive motor (8) that is held in a motor housing (2). At least one handle (4) is provided, with a vibration gap (12) being formed between the handle (4) and the motor housing (2). The vibration gap (12) permits a relative movement between handle (4) and motor housing (2). The handle (4) is connected to the motor housing (2) via at least one anti-vibration device (13, 14, 15, 16, 31, 49, 50, 63) that bridges the vibration gap (12). The anti-vibration device (15, 16, 31, 49, 50, 63) has a longitudinal center axis (23, 24). The anti-vibration device (15, 16, 31, 49, 50, 63) bridges the vibration gap (12) via at least one tension element. The anti-vibration device (15, 16, 31, 49, 50, 63) also has a spring (17, 32, 33, 51, 55, 72, 73) arranged functionally in series with the tension element.

16 Claims, 4 Drawing Sheets

HANDHELD WORK APPARATUS

CROSS REFERENCE TO RELATED APPLICATION

This application claims priority of German patent application no. 10 2010 055 673.4, filed Dec. 22, 2010, the entire content of which is incorporated herein by reference.

BACKGROUND OF THE INVENTION

U.S. Pat. No. 5,368,107 discloses a chain saw where the arm is resiliently held in the forward region via a coil spring and a rubber buffer. In the middle region of the arm additional rubber buffers are arranged on both sides of the arm. The rubber buffers transmit forces only under pressure and only in their longitudinal direction. Because no transverse forces are transmitted in the middle region of the arm a good guiding behavior results.

Rubber plugs or foam damping elements exhibit a hardening when dynamically stressed. Thus, an undesired change in the damping characteristics results during operation.

SUMMARY OF THE INVENTION

It is an object of the invention to provide a handheld work apparatus of the type described above which has good damping behavior.

The handheld work apparatus of the invention includes: a motor housing; a drive motor held in the motor housing; at least one handle; a vibration gap formed between the handle and the motor housing; the vibration gap being configured to allow a relative movement of the handle and the motor housing; an anti-vibration device configured to bridge the vibration gap and interconnect the handle and the motor housing; the anti-vibration device defining a longitudinal center axis; the anti-vibration device including at least one tension element via which the anti-vibration device bridges the vibration gap; and, a spring arranged functionally in series with the tension element.

As a result of using at least one tension element for bridging the vibration gap instead of the known pressure-loaded rubber buffers, the dynamic hardening which occurs in known rubber buffers can be avoided. In order to achieve a good damping effect it is provided that the anti-vibration device has a spring which is arranged functionally in series with the tension element. Thus, a damping in the direction of the longitudinal center axis of the anti-vibration device can be achieved. As a result of the connection in series it can be achieved that no transverse forces are transmitted over the vibration gap. The longitudinal center axis of the anti-vibration device is, in this case, the longitudinal center axis of the tension element.

A simple configuration results when the tension element comprises a cable to bridge the vibration gap. The anti-vibration device according to the invention differs from known breakaway prevention devices with a cable in that no additional damping element which acts parallel to the tension element and could also transmit transverse forces is present. In particular, the cable is a metal cable, preferably a steel cable. Thus, a simple configuration and a robust construction result.

Advantageously, the anti-vibration device forms a stop in the direction of the longitudinal center axis which limits the maximum width of the vibration gap. The vibration gap is advantageously bridged exclusively via the tension element, so that it is ensured that forces are transmitted only in the direction of the longitudinal center axis.

Advantageously, the tension element has at least one holding element which is arranged in a corresponding receptacle and is fixedly connected to the tension element. The holding element can, for example, be arranged at one end of the tension element and be configured as an end piece or can be arranged between the ends of the tension element and be configured as a support. Advantageously, the tension element supports itself against the base of the receptacle. In order to avoid a transmission of transverse forces, that is forces perpendicular to the longitudinal center axis, via the base of the receptacle it is provided that the base has an opening through which the tension element projects, in which case the diameter of the opening is at least 1.5 times, in particular 2 times, the diameter of the tension element in the area of the opening. The opening is selected in such a manner that the tension element does not hit the edge of the opening during operation. For this, a conical configuration of the opening can also be advantageous. In the case of a conical opening the given diameter ratio relates to the largest diameter of the opening. The diameter of the end piece is advantageously larger than the diameter of the opening so that a securing in the axial direction results. In order to enable simple attachment of the tension element it can be provided that at least one opening is configured as a slit. The width of the slit then represents the diameter of the opening.

Advantageously, at least one end of the tension element is held resiliently. A simple configuration results when a compression spring is arranged between the base of the receptacle and the holding element. The compression spring is expediently a metal spring, in particular a steel spring, advantageously a coil compression spring. It can, however, also be provided that the compression spring is configured as a disc spring assembly. As a result of the configuration as a metal spring the dynamic hardening which occurs with damping and spring elements made of elastomer is avoided. In particular, if the spring is pre-tensioned in the idle state, the metal spring element offers substantial advantages compared to a spring element made of elastomer. If a metal spring element and a spring element made of elastomer are each so configured that the same spring stiffness is given in the idle state, then the dynamic spring stiffness of the spring element made of elastomer is substantially greater than the metal spring as a result of the material's properties. In the deflected state the dynamic spring stiffness increases even more because of the progressive characteristic curve of the spring element made of elastomer, so that a substantially greater spring stiffness results during operation. The linear characteristic curve associated with a metal spring element leads to the spring stiffness always being the same statically and dynamically both in the idle state and in the deflected state, whereby an advantageous guiding behavior of the work apparatus results. The compression spring is, in particular, arranged in the receptacle assigned to the handle. There is sufficient space available to arrange the compression spring there.

Advantageously, the anti-vibration device does not create an operative connection between the handle and the motor housing when the damping width drops below a minimum value. When there is very little distance between the motor housing and the handle housing the tension element, in particular the cable, lies loosely in the receptacles. Advantageously, the handle is part of a handle frame of the work apparatus. The handle frame has an arm over which the motor housing of the work apparatus extends and whereby the vibration gap is bridged by at least one tension element on both opposite longitudinal sides of the arm.

Advantageously, the anti-vibration device is pre-tensioned in the idle state of the motor housing and the handle frame. In particular, a pre-tensioning is provided in the longitudinal direction of the anti-vibration device in both deflection directions. For this, in particular, two springs acting in opposing directions are provided. As a result of the pre-tensioning, manufacturing tolerances can be compensated. Thus it is ensured that a damping occurs even in the case of small deflections from the idle state. Because of the pre-tensioning both oppositely arranged springs are effective even in the deflected state, so that an increased spring force results which is advantageous for the guiding behavior of the work apparatus.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
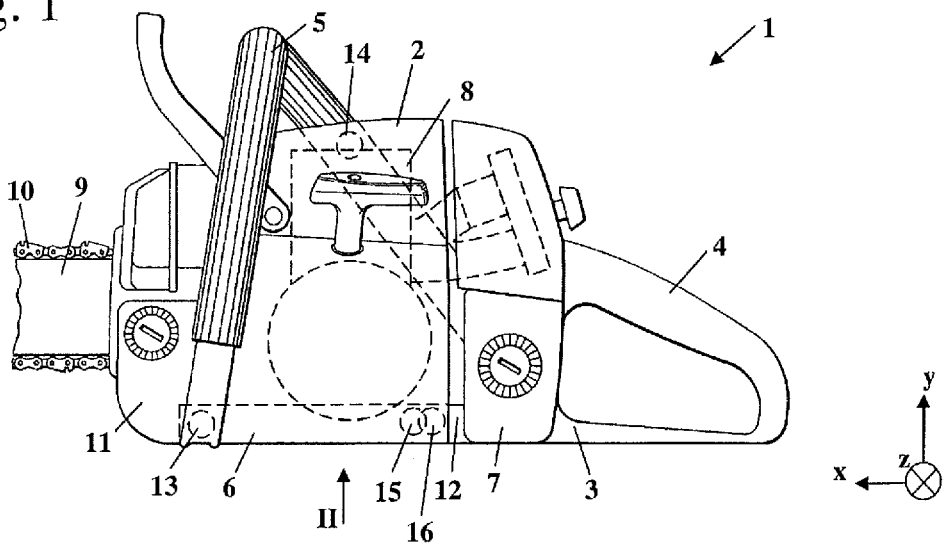
FIG. 1 is a schematic side view of a chain saw.

FIG. 1 shows a chain saw 1 as an example embodiment of a handheld work apparatus. The suggested configuration of an anti-vibration device can, however, also be used in other handheld work apparatuses, for example, a cut-off machine, a brushcutter or the like.

The chain saw 1 has a motor housing 2 in which a drive motor 8 is arranged. The drive motor 8 is configured as a combustion engine, in particular a two-stroke engine or as a mixture lubricated four-stroke engine. The drive motor can, however, also be an electric motor. The chain saw 1 also has a handle frame 3 on which two handles, that is, a back handle 4 and a handle bar 5 are arranged. The fuel tank 7 is integrated on the handle frame 3. The handle frame 3 has an arm 6 which projects forward at the base of the chain saw 1 and over which the motor housing 2 extends. A guide bar 9, on which a saw chain 10 is driven in rotation, projects forward at the opposite end from the back handle 4. A lubrication oil tank 11 is integrated on the motor housing 2 adjacent to the guide bar 9.

The motor housing 2 is separated from the handle frame 3 via a vibration gap 12 which permits movement of the two components relative to each other. In the example embodiment, the vibration gap 12 is bridged by a total of four anti-vibration devices (13, 14, 15, 16). The anti-vibration device 13 is arranged in the region of the front end of the arm 6 between the arm 6 and the handle bar 5. The anti-vibration device 14 supports the handle bar 5 relative to the motor housing 2. Two anti-vibration devices (15, 16) are arranged on the end of the arm 6 which faces the fuel tank 7.

Figure 2:
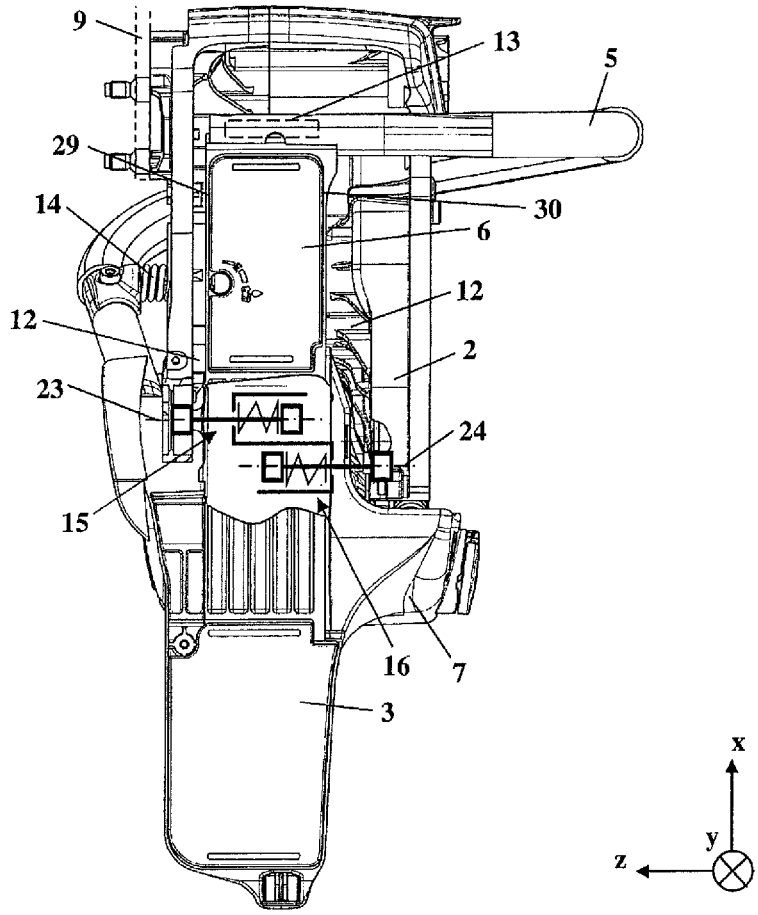
FIG. 2 is a view from below onto the chain saw of FIG. 1 in the direction of arrow II of FIG. 1.

As FIG. 2 shows, the arm 6 has two longitudinal sides 29 and 30. The vibration gap 12 runs between the arm 6 and the motor housing 2 on both longitudinal sides (29, 30). The anti-vibration device 15 is arranged on the longitudinal side 29 which faces the guide bar 9 and the anti-vibration device 16 is arranged on the opposite longitudinal side 30. The anti-vibration device 15 has a longitudinal center axis 23 and the anti-vibration device 16 has a longitudinal center axis 24. The two longitudinal center axes (23, 24) lie in the transverse direction (z) of the chain saw 1. The aim 6 like the guide bar 9 extends in the longitudinal direction (x). The vertical direction (y) (FIG. 1) runs perpendicular hereto.

Figure 3:
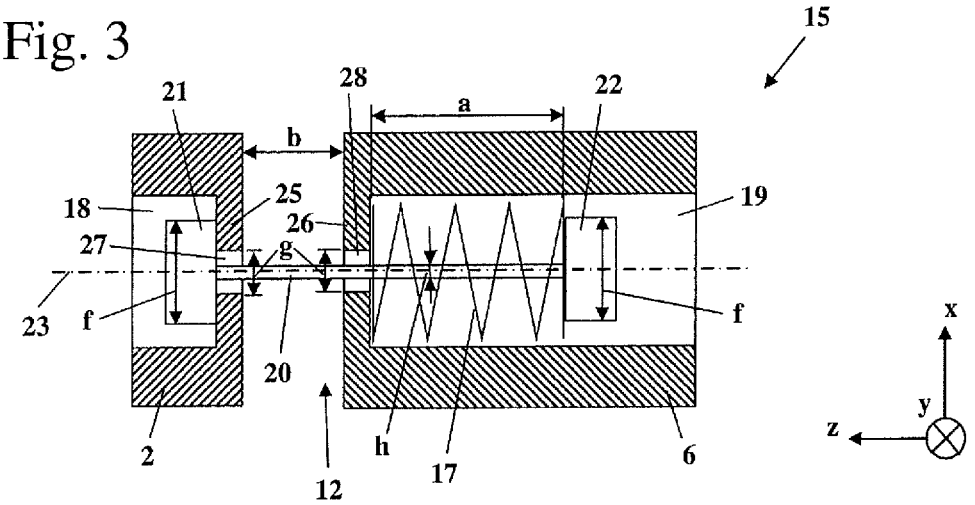
FIG. 3 is a schematic section view of the anti-vibration device in a damping state.

FIG. 3 shows the anti-vibration device 15 in an enlarged view. The anti-vibration device 16 is configured identically and is arranged mirror symmetrical to the anti-vibration device 15. The anti-vibration device 15 has a tension element, namely a cable 20, which bridges the vibration gap 12. The cable 20 is configured as a steel cable and has end pieces 21 and 22 at its respective ends. The motor housing 2 has a receptacle 18 which is configured approximately pot-shaped. The end piece 21 is arranged in the receptacle 18. The cable 20 projects through an opening 27 in the base 25 of the receptacle 18 to the arm 6. There is also a pot-shaped receptacle 19 formed in the arm 6 which is deeper than the receptacle 18 in the motor housing 2. The cable 20 projects through an opening 28 in the base 26 of the receptacle 19 into the interior of the receptacle 19. The second end piece 22 is arranged in the receptacle 19. The end piece 22 supports itself in relation to the base 26 of the receptacle 19 via a spring 17 which is configured as a coil compression spring. The spring 17 can also be configured as a disc spring assembly or the like. The spring 17 can also be configured as a tension spring. For this, the spring 17 is advantageously arranged on the side of the end piece 22 which is opposite the base 26. As a result of the suggested embodiment as a compression spring a compact construction results. The spring 17 is in particular a metal spring, advantageously a steel spring.

In the position shown in FIG. 3, the arm 6 is in the idle state and the vibration gap 12 has a smallest damping width (b). The spring 17 is in the pre-tensioned state and has a length (a). The spring of the anti-vibration device 16 is correspondingly pre-tensioned, so that both springs are active during a deflection of the arm 6 out of the idle state. The cable 20 has a diameter (h) which is substantially smaller than the diameter (g) of the two openings 27 and 28. The diameter (g) is advantageously at least 1.5 times, in particular 2 times the diameter (h). As a result, an unimpeded relative movement between the motor housing 2 and the arm 6 is possible in the plane defined by the longitudinal direction (x) and the vertical direction (y). As FIG. 3 also shows, the end pieces 21 and 22 each have a diameter (f) which is substantially larger than the diameter (g) of the openings 27 and 28. Thus, the end pieces 21 and 22 are secured in the longitudinal direction.

In order to achieve a simple mounting of the cable 20, it can be provided that at least one of the openings (27, 28) is configured as lateral slits through which the end piece (21, 22) is laterally inserted and hooked into the receptacle (18, 19).

Depending on the elasticity of the cable 20, an articulated fixation of the ends of the cable 20 on the end pieces 21 and 22 can be advantageous.

Figure 4:
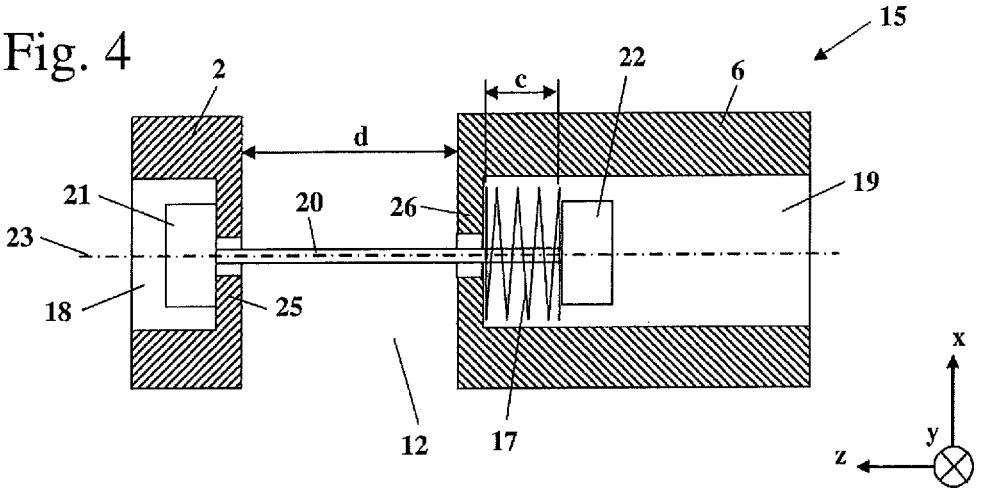
FIG. 4 is a schematic section view of the anti-vibration device in a different damping state than shown in FIG. 3.

FIG. 4 shows the anti-vibration device 15 with maximum width (d) of the vibration gap 12. The spring 17 is compressed to a block length (c). A further movement of the motor housing 2 and the arm 6 is prevented by the end pieces (21, 22) which support themselves on the bases 25 and 26 of the receptacles 18 and 19 and by the spring 17 which cannot be further shortened. In this position, the anti-vibration device 15 forms a stop.

Figure 5:
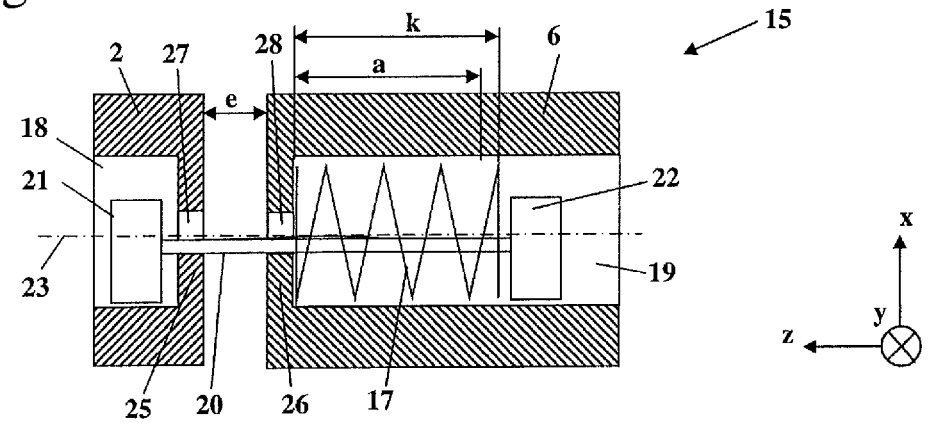
FIG. 5 is a schematic section view of the anti-vibration device in a different damping state than shown in FIGS. 3 and 4.

FIG. 5 shows the motor housing 2 and the arm 6 with a distance (e) which is smaller than the smallest damping width (b). In this state, the spring 17 is in its unstressed length (k). The end pieces 21 and 22 do not rest on the base 25 or on the spring 17 but lie loosely in the receptacles 18 and 19. In this position the anti-vibration device 15 applies no damping effect.

Figure 6:
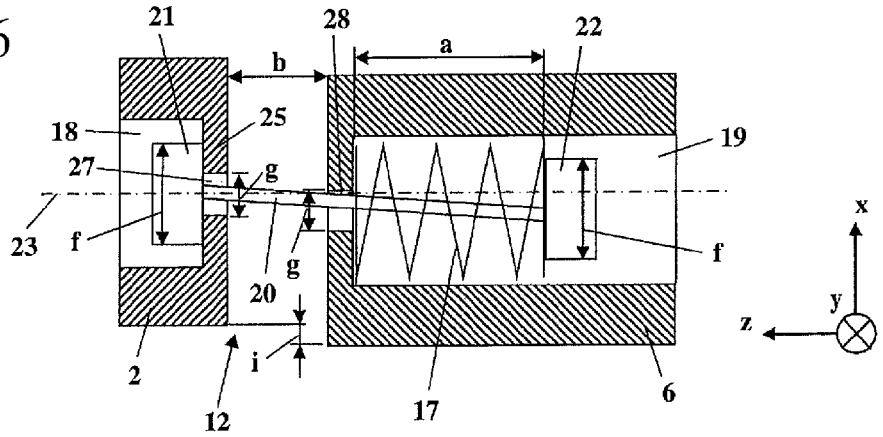
FIG. 6 is a schematic section view of the anti-vibration device in a different damping state than shown in FIGS. 3 to 5.

FIG. 6 shows the motor housing 2 and the arm 6 with a lateral offset (i). The lateral offset (i) in the embodiment is present in the longitudinal direction (x). Additionally or alternatively, an offset can be present in the vertical direction (y). As FIG. 6 shows, the cable 20 is inclined in relation to the longitudinal center axis 23. The cable 20 does not touch the edge of the openings 27 and 28, so that no damping effect results in the plane defined by the longitudinal direction (x) and the vertical direction (y). Only when the motor housing 2 and the arm 6 are moved away from each other in the direction of the longitudinal center axis 23 does a damping effect occur as a result of the compressing of the spring 17.

The tension element can be a solid component which is articulately mounted at least one end instead of being a cable. Instead of an additional spring 17, the tension element can be configured resiliently and thus achieve a damping effect in the direction of the longitudinal center axis 23.

FIGS. 7 to 12 show embodiments of anti-vibration devices. The same reference characters refer to the same corresponding elements as in the previous figures.

Figure 7:
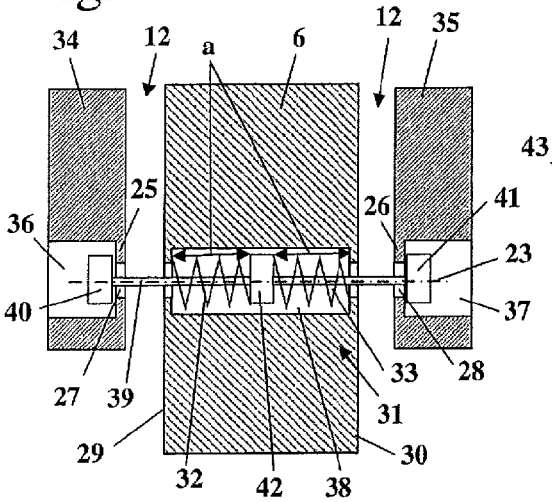
FIG. 7 is an embodiment of an anti-vibration device in a damping state.
Figure 8:
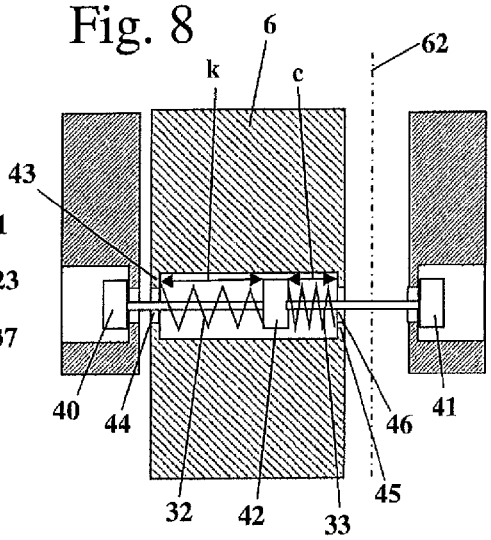
FIG. 8 shows the anti-vibration device of FIG. 7 in a different damping state.

FIG. 7 shows an anti-vibration device 31 which includes a tension element, namely a cable 39, in particular a metal cable.

End pieces 40 and 41 are fixed to the ends of the cable 39. The end piece 40 is arranged in a receptacle 36 in a first portion 34 of the motor housing 2 arranged adjacent to the longitudinal side 29 of the arm 6. The second end piece 41 is arranged in a receptacle 37 provided in a second portion 35 of the motor housing 2. The second portion 35 is arranged on the opposite, second longitudinal side 30 of the arm 6. The cable 39 projects through an opening 27 in the base 25 of the receptacle 36 and through an opening 28 in the base 26 of the receptacle 37.

In the arm 6 is formed a receptacle 38 through which the cable 39 projects. In the receptacle 38 are arranged two springs 32 and 33, which are formed in particular as metal compression springs. The cable 39 penetrates through the springs 32 and 33 in the embodiment. In a central region of the cable 39, a support 42 is fixed to the cable 39. One end of the spring 32 rests against a wall portion 43 of the receptacle 38, and the other end of the spring 32 rests against the support 42. One end of the spring 33 bears against the support 42, and the other end of the spring 33 bears against the opposite wall portion 45 of the receptacle 38. The wall portions 43 and 45 each have an opening (44, 46) through which the cable 39 projects. The dimensions of the openings 27, 28, 44 and 46 correspond to the dimensions shown in FIG. 6.

FIG. 7 shows the anti-vibration device 31 in the unstressed state, that is, in the idle position of arm 6 and handle frame 2. In this state, both springs 32 and 33 have a length (a). Both springs 32 and 33 are pre-tensioned. In the event of a deflection of the arm 6 in the direction shown in FIG. 8, the spring 32 relaxes and the spring 33 is stressed. As a result, the spring force of the spring 32 and the spring force of the spring 33 counteract one another at the support 42. In the event of the deflection of the arm 6 shown in FIG. 8, that is, away from the idle position shown schematically by the line 62, the spring 32 has a length (k) which corresponds to the unstressed length of the spring 32. The spring 33 has a block length (c). Since the spring 33 cannot be shortened any further from the block length (c), the anti-vibration device 31 constitutes a stop in this position. In the opposite direction, the spring 32 acts as a stop once it has been compressed to its block length (c).

Figure 9:
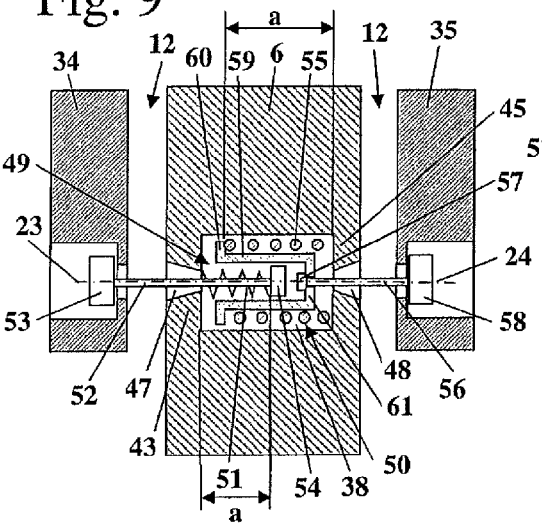
FIG. 9 is a further embodiment of an anti-vibration device in a damping state.

FIG. 9 shows an exemplary embodiment of two anti-vibration devices 49 and 50, which are of compact construction. The anti-vibration device 49 has a cable 52, to the ends of which are fixed end pieces 53 and 54. The second end piece 54 is arranged in a receptacle 38 and is supported with respect to the wall portion 43 of the receptacle 38 via a spring 51 configured as a metal compression spring. The wall portion 43 has an opening 47 which widens conically in the direction of the vibration gap 12. As a result, a relatively significant movement of the arm 6 perpendicular to the longitudinal center axis of the anti-vibration devices 49 and 50 is possible.

The anti-vibration device 50 has a cable 56, to the ends of which are fixed end pieces 57 and 58. The cable 56 projects through an opening 48 in the wall portion 45, the opening widening conically in the direction of the vibration gap 12. The end piece 57 is arranged in a pot 59 and is supported against the base 61 of the pot 59. The pot 59 substantially surrounds the spring 51 of the anti-vibration device 49. The end piece 54 is arranged in the pot 59. On its side facing the wall portion 43, the pot 59 has an outer rim 60, against which a spring 55 is supported. The spring 55 is likewise formed as a metal compression spring. The second end of the spring 55 is supported against the wall portion 45. The arrangement of the spring 51 inside the spring 55 results in a small overall size in the direction of the longitudinal center axes (23, 24) of the anti-vibration devices 49 and 50.

Figure 10:
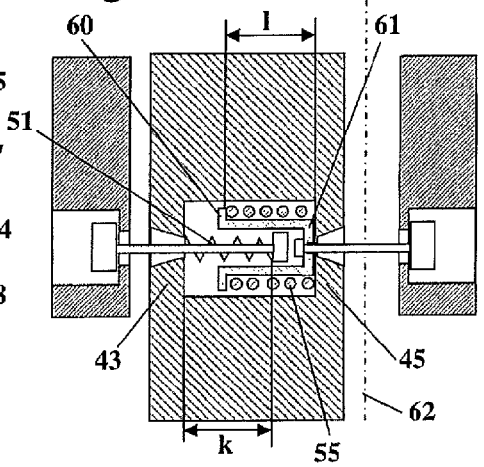
FIG. 10 shows the anti-vibration device of FIG. 9 in a different damping state.

In FIG. 9, both springs 51 and 55 are shown in their length (a) which corresponds to the length in the idle state. In the event of a deflection of the arm 6, as shown in FIG. 10, away from the line 62 that schematically indicates the idle state, the spring 55 is shortened and the spring 51 lengthens to its unstressed length (k). The spring 55 has a length (l) that is greater than the block length. A further deflection is not possible because the base 61 bears against the wall portion 45 and thereby forms a stop for the anti-vibration device. In the opposite direction, the outer rim 60 with the wall portion 43 forms a stop. Alternatively, it is also possible to provide for the springs 51 and 55 to be compressed to a block in order thereby to form a stop.

Figure 11:
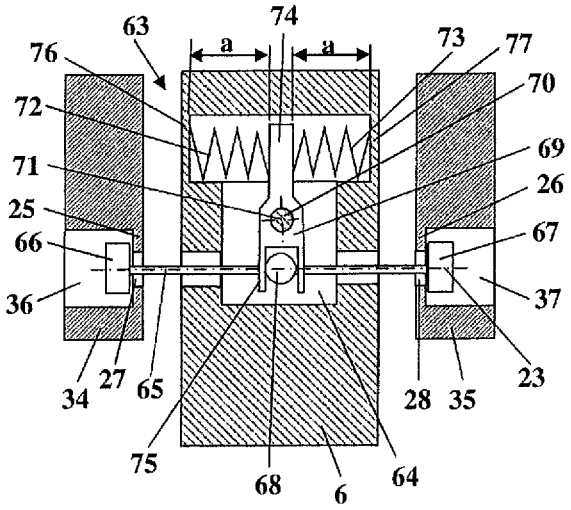
FIG. 11 is another embodiment of an anti-vibration device in a damping state; and, FIG. 12 shows the anti-vibration device of FIG. 11 in a different damping state.
Figure 12:
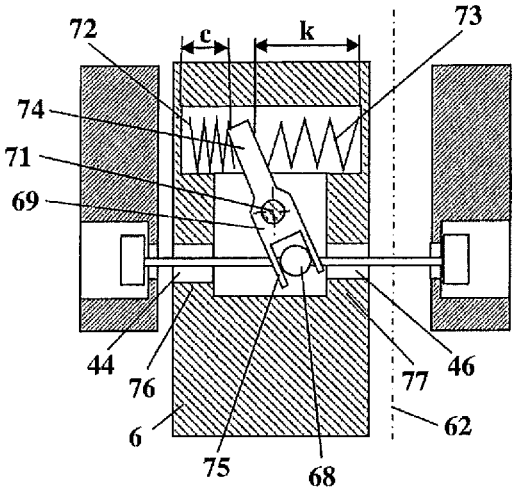

A flat overall shape in the region of the tension element can be achieved by means of the configuration shown in FIGS. 11 and 12. The anti-vibration device 63 shown here has a cable 65, to the ends of which are fixed end pieces 66 and 67. The end pieces 66 and 67 are arranged in receptacles 36 and 37 of the motor housing 2. The cable 65 extends through the arm 6. In the region of the cable 65, the arm 6 has a receptacle 64. A support 68 is fixed to the cable 65 in the region arranged in the receptacle 64. A fork-shaped end 75 of a pivot arm 69 engages around the support 68. A bearing journal 70 of the pivot arm 69 is mounted pivotably about a pivot axis 71. The bearing journal 70 is arranged in a central region of the pivot arm 69, so that the fork-shaped end 75 is deflected in the opposite direction to an opposite actuating portion 74 of the pivot arm 69. Two springs 72 and 73 are arranged adjacent to the actuating portion 74, on opposite sides of the actuating portion 74, which springs are supported against opposite wall portions 76 and 77 of the receptacle 64. In the idle state shown in FIG. 11, both springs 72 and 73 have a length (a). In the event of a deflection of the arm 6 into the position shown in FIG. 12, the pivot arm 69 pivots about the pivot axis 71. The actuating portion 74 compresses the spring 72. The spring 73 is correspondingly extended. In the position in FIG. 12, the spring 72 has its block length (c). Thus, the spring 72 constitutes a stop. The spring 73 has its unstressed length (k). However, the spring 73 may also still be prestressed in the position shown in FIG. 12. Instead of reaching a stop via the spring 72 or 73, it is also possible for the fork-shaped end 75 to come into contact with the wall portions 76 and 77 and thereby form a stop.

It is understood that the foregoing description is that of the preferred embodiments of the invention and that various changes and modifications may be made thereto without departing from the spirit and scope of the invention as defined in the appended claims.

What is claimed is:

1. A handheld work apparatus comprising:
a motor housing;
a drive motor held in said motor housing;
at least one handle;
a vibration gap formed between said handle and said motor housing;
said vibration gap being configured to allow a relative movement of said handle and said motor housing;
a first anti-vibration device configured to bridge said vibration gap and interconnect said handle and said motor housing;
said first anti-vibration device defining a longitudinal center axis;
said first anti-vibration device including at least one tension element via which said first anti-vibration device bridges said vibration gap and transmits a tension force between said motor housing and said handle;
a spring operating functionally in series with said tension element so as to cause said tension force to act on said spring;
said first anti-vibration device bridging said vibration gap exclusively via said tension element and said tension element transmits forces only in the direction of said longitudinal center axis;
a second anti-vibration device likewise including a tension element;
a handle frame having an arm over which said motor housing extends;
said handle being part of said handle frame;
said arm having first and second longitudinal sides;
said vibration gap including a first vibration gap segment formed between said motor housing and said first longitudinal side;
said motor housing and said second longitudinal side conjointly defining a second vibration gap segment of said vibration gap; and,
said first and second vibration gap segments being bridged by the tension elements of corresponding ones of said first and second anti-vibration devices.

2. The handheld work apparatus of claim 1, wherein said tension elements each includes a cable configured to bridge corresponding ones of said vibration gaps.

3. The handheld work apparatus of claim 2, wherein said cables are a metal cable.

4. The handheld work apparatus of claim 1, wherein said anti-vibration devices each defines a stop in the direction of said longitudinal center axis which delimits the maximum width (d) the corresponding ones of said vibration gap.

5. The handheld work apparatus of claim 1 further comprising:
each one of said anti-vibration devices including
a receptacle;
the tension element corresponding to said one anti-vibrations device having at least one holding element which is fixedly connected thereto; and,
said holding element being assigned to said receptacle and said holding element being arranged in said receptacle.

6. The handheld work apparatus of claim 5, wherein the tension element of each one of said anti-vibration devices is supported on the receptacle corresponding thereto.

7. The handheld work apparatus of claim 5, wherein:
said receptacle has an opening having a diameter (g);
the tension element of each one of said anti-vibration devices has a diameter (h) and is configured to project through said opening of said receptacle;
said diameter (g) of said opening is at least approximately 1.5 times the diameter (h) of the tension element corresponding thereto in the region of said opening.

8. The handheld work apparatus of claim 7, wherein said holding element has a diameter (f) which is greater than said diameter (g) of said openings of said receptacle.

9. The handheld work apparatus of claim 5, wherein:
said receptacle has an opening having a diameter (g);
the tension element of each one of said anti-vibration devices has a diameter (h) and is configured to project through said opening of said receptacle;
said diameter (g) of said opening is at least approximately 2 times the diameter (h) of the tension element corresponding thereto in the region of said opening.

10. The handheld work apparatus of claim 5, wherein said tension elements are held resiliently in the longitudinal direction.

11. The handheld work apparatus of claim 10 further comprising a compression spring arranged between a wall section of said receptacle and said holding element.

12. The handheld work apparatus of claim 11, wherein said compression spring is a metal spring.

13. The handheld work apparatus of claim 5, wherein said receptacle is formed in one of said motor housing or said handle.

14. A handheld work apparatus comprising:
a motor housing;
a drive motor held in said motor housing;
at least one handle;
a vibration gap formed between said handle and said motor housing;
said vibration gap being configured to allow a relative movement of said handle and said motor housing;
an anti-vibration device configured to bridge said vibration gap and interconnect said handle and said motor housing;
said anti-vibration device defining a longitudinal center axis;
said anti-vibration device including at least one tension element via which said anti-vibration device bridges said vibration gap and transmits a tension force between said motor housing and said handle;
a compression spring operating functionally in series with said tension element so as to cause said tension force to act on said spring;

said anti-vibration device bridging said vibration gap exclusively via said tension element and said tension element transmits forces only in the direction of said longitudinal center axis;

a receptacle;

said tension element having at least one holding element which is fixedly connected thereto;

said holding element being assigned to said receptacle and said holding element being arranged in said receptacle;

said tension element being held resiliently in the longitudinal direction;

said compression spring arranged between a wall section of said receptacle and said holding element; and, said handle having said receptacle associated therewith and said compression spring being arranged in said receptacle associated with said handle.

15. A motor-driven chain saw comprising:

a motor housing;

a drive motor held in said motor housing;

a handle frame with a portion thereof defining a handle;

said handle frame and said motor housing conjointly defining a vibration gap therebetween for permitting said handle frame and said motor housing to move relative to each other;

at least two antivibration devices connecting said handle frame to said motor housing;

each of said antivibration devices including a tension element and a spring;

said springs operating functionally in series with corresponding ones of said tension elements;

said handle frame including an arm over which said motor housing extends;

said arm having two longitudinal sides lying opposite each other;

said vibration gap extending along both of said longitudinal sides of said arm;

said tension elements of respective ones of said antivibration devices bridging said vibration gap at corresponding ones of said longitudinal sides;

said vibration gap defining a smallest damping width (b) below which said vibration gap can narrow at one of said longitudinal sides of said arm during operation of the motor-driven chain saw; and, the one of said antivibration devices associated with said one longitudinal side being configured to transmit no force between said one longitudinal side and said motor housing when there is a drop below said smallest damping width (b).

16. The motor-driven chain saw of claim 15, wherein the spring of at least one of said anti-vibration devices is pretensioned in the rest position of said handle frame and said motor housing.

* * * * *

UNITED STATES PATENT AND TRADEMARK OFFICE

CERTIFICATE OF CORRECTION

PATENT NO. : 9,216,517 B2
APPLICATION NO. : 13/333796
DATED : December 22, 2015
INVENTOR(S) : J. Kurzenberger et al.

It is certified that error appears in the above-identified patent and that said Letters Patent is hereby corrected as shown below:

IN THE SPECIFICATION

In column 4:
Line 19: delete "aim" and substitute -- arm -- therefor.

In column 5:
Line 32: add -- at -- after "mounted at".

IN THE CLAIMS

In column 7:
Line 67: delete "a metal cable" and substitute -- metal cables -- therefor.

In column 8:
Line 2: delete "defines" and substitute -- define -- therefor.
Line 4: delete "gap" and substitute -- gaps -- therefor.

Signed and Sealed this
Fifth Day of April, 2016

Michelle K. Lee

Michelle K. Lee
*Director of the United States Patent and Trademark Office*